United States Patent [19]

Schadow

[11] 4,091,732

[45] May 30, 1978

[54] FUEL INJECTION

[75] Inventor: Klaus C. Schadow, Ridgecrest, Calif.

[73] Assignee: The United States of America as represented by the Secretary of the Navy, Washington, D.C.

[21] Appl. No.: 702,387

[22] Filed: Jul. 6, 1976

[51] Int. Cl.[2] ..... F42B 15/10

[52] U.S. Cl. ..... 102/49.3; 60/270 S

[58] Field of Search ..... 102/49.3; 60/257, 261

[56] References Cited

U.S. PATENT DOCUMENTS

| | | | |
|---|---|---|---|
| 3,273,334 | 9/1966 | Tanczos et al. | 60/270 R |
| 3,486,339 | 12/1969 | Owens et al. | 60/261 |
| 3,807,169 | 4/1974 | Bradford | 60/261 |

*Primary Examiner*—Samuel Feinberg

*Attorney, Agent, or Firm*—R. S. Sciascia; Roy Miller; W. Thom Skeer

[57] ABSTRACT

A method and apparatus for improving combustion efficiency in external burning assisted projectiles by slowing te exit speed of fuel-rich exhaust gases to subsonic flow.

8 Claims, 3 Drawing Figures

FUEL INJECTION

CROSS REFERENCE TO RELATED APPLICATION

The device disclosed in this application is similar in some aspects to that disclosed in assignee's copending application Ser. No. 702,641, filed of even date.

BACKGROUND OF THE INVENTION

Devices for the manipulation of base pressure on a bluffbase body by combustion in a region around the base have been investigated, and a paper entitled "Theoretical Consideration of Combustion Effects on Base Pressure in Supersonic Flight," by Warren C. Strahle may be found in the publication by Combustion Institute, Pittsburgh, Pa. entitled "Twelfth Symposium [International] on Combustion," (1969) pp. 1163–1173.

Prior investigations disclosed by Strahle indicate that a certain amount of thrust is attainable in the flight of a solid propellant assisted projectile by achieving combustion of the fuel-rich exhaust in a region around the base of the projectile.

SUMMARY OF THE INVENTION

The present invention includes a method and apparatus for increasing base pressure on a bluff-base portion of a projectile or missile by improved combustion of exhaust gases in a region around the base.

More particularly, the invention relates to a method and apparatus for increasing combustion efficiency of the fuel-rich exhaust gases by reducing the exit speed of the exhaust gases to subsonic flow.

DESCRIPTION OF THE PREFERRED EMBODIMENT

Figure 1:
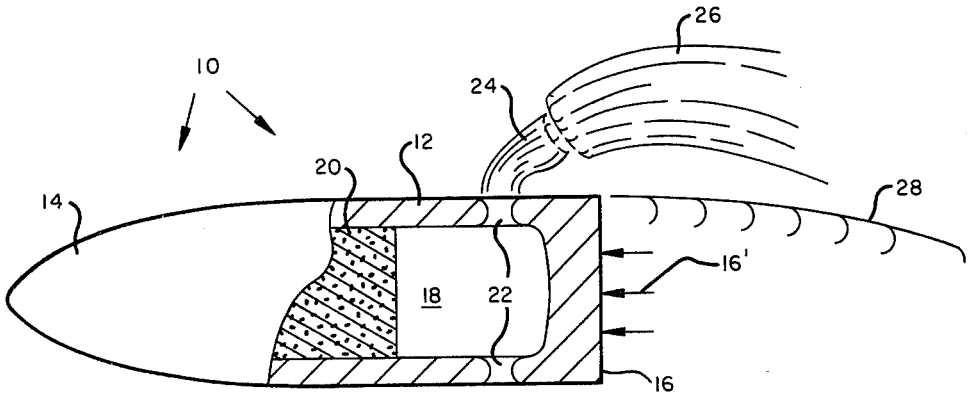
PRIOR ART Fig. 1
FIG. 1 is a side elevation partly in section of a rocket assisted projectile representing the prior art.

A better understanding may be had of the scope of the present invention when viewed in the light of the prior art device shown generally at 10 in FIG. 1. The rocket assisted projectile generally indicated at 10 in FIG. 1 comprises a projectile casing 12 having a nose portion 14 and a bluff base portion 16. The body or casing 12 contains a rocket motor consisting essentially of a propellant grain 20 in the forward end of the body and a combustion chamber 18 aft of the grain 20. Combustion chamber 18 communicates externally of body 12 through a plurality of injection ports 22.

When the propellant grain 20 is burned in chamber 18, the products of combustion are injected into the airstream flowing past the projectile 10 and, if sufficiently fuel-rich, these products of combustion will burn externally of body 12. When these products of combustion 24 are further burned upon injection into the passing airstream at 26, the base pressure may be substantially increased, thus enhancing the speed of the projectile.

In the following it will be evident that the combustion processes of the external burning assisted projectiles are similar to those of the disclosed rocket system (ramjet). Although the external burning assisted projectile is not a ramjet, previous results of research in the area of ducted rockets will be discussed in some detail in the following.

Experimental studies at the Naval Weapons Center over the past three years have resulted in a new understanding of boronloaded plume combustion processes in ducted rocket systems. Further tests now show that the results of the ducted rocket program can be applied to the combustion processes in external burning to give further base pressure increase on projectiles.

The exhaust gases 24, in FIG. 1 are injected into the airstream at supersonic flow. From the preliminary tests which will be further discussed with relation to FIG. 3, the base pressure, indicated at 16', was increased considerably when the exhaust gases were slowed to subsonic speed in accordance with the present invention.

Figure 2:
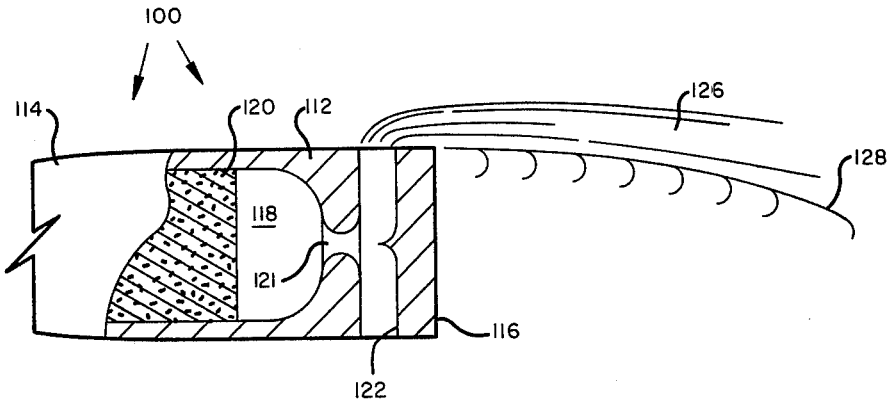
FIG. 2 is a view similar to FIG. 1 of a rocket assisted projectile according to the present invention.

The rocket assisted projectile generally indicated at 100 in FIG. 2 is similar in some respects to the prior art projectile illustrated in FIG. 1 and certain details in FIG. 2, corresponding to similar structure in FIG. 1, bear similar numbers to those parts in FIG. 1 increased by 100. Thus, the body is shown at 112 having a nose section 114 and a bluff-base 116. Between the combustion chamber 118 and the injector ports 122, however, there is a primary nozzle 121. The introduction of this primary nozzle 121 within the body 112, in conjunction with the exhaust or injector ports 122, causes the gaseous products of combustion passing from chamber 118 to be slowed to subsonic flow when emanating from ports 122.

It is to be noted in the FIG. 2 device that the gaseous products of combustion 126 begin burning in the extreme forward end of the mixing region between the fuel and the airstream as the products of combustion exit from ports 122. By reducing the velocity of the exhaust gases from supersonic to subsonic speed the base pressure has been noticeably increased. At supersonic exhaust velocity, which was previously used as shown in FIG. 1, base pressure has been increased from 4.8 psia to 12.3 psia during external burning. At subsonic exhaust velocity, however, the base pressure has been increased according to the invention, for example, from 4.8 psia to 17.4 psia with other motor parameters remaining constant.

The injector port 122 of FIG. 2 may take many forms, including a plurality of individual injector ports around the periphery of the projectile near the bluff-base 116 or may consist of a continuous opening around the periphery of body 112. The size, number and arrangement of these ports may be varied according to the characteristics of the solid propellant being used, for example.

Figure 3:
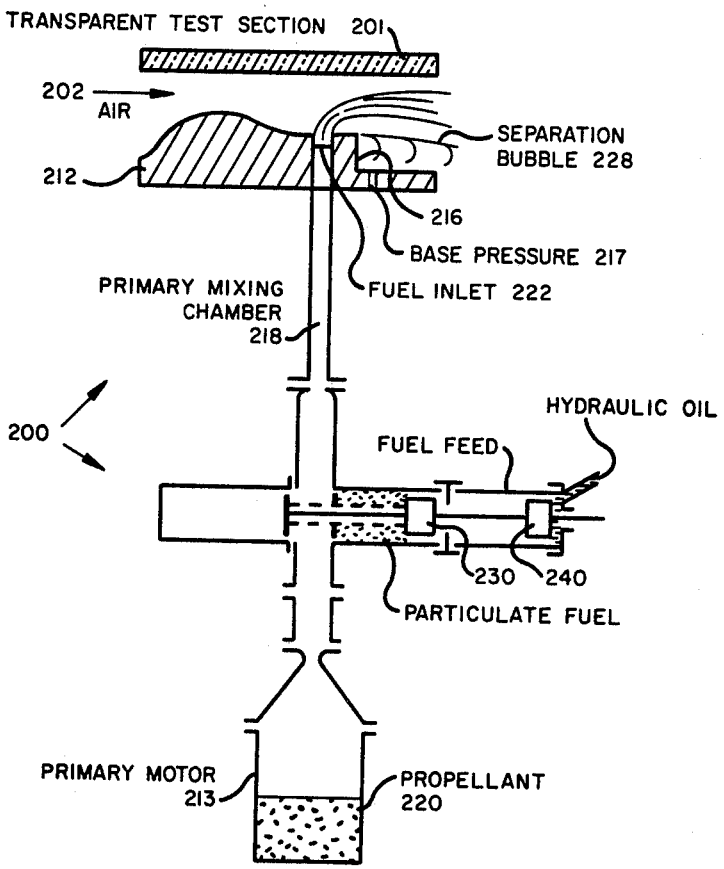
FIG. 3 is a diagrammatic side elevational view of a test arrangement for practicing the method according to the present invention.

A test arrangement for investigating the relative efficiency of various arrangements according to the present invention is shown in FIG. 3. The test system generally indicated by the numberal 200 comprises a closed transparent test section 201 through which the burning characteristics of the various fuels can be observed and photographically recorded. Air at supersonic speed is introduced into the area between the transparent section 201 and a body simulating the projectile at 212, as shown by the arrow 202. The bluff-base of simulated projectile 212 is simulated by a step 216 and base pressure is recorded through an opening 217. Fuel-rich gases are supplied by a primary motor 213 burning a propellant 220 and, in some instances, a particulate fuel is hydraulically fed into the gas stream to be mixed in chamber 218 before being injected into the airstream. The particulate fuel is fed by a fuel piston 230 actuated by a hydraulic piston 240.

The tests revealed that particulate fuel additives (boron, magnesium-aluminum/alloy for example) can be used to enhance the combustion of the gaseous fuel components from the primary motor and the air within the mixing region. In tests at a primary chamber temperature of 1500° K, plume ignition did not occur in the air without additives; however, ignition was achieved when the plume was loaded with hot boron particles.

The results of these preliminary tests indicate that the conditions favorable for achieving high combustion efficiency in external burning ramjets are similar to those in ducted rockets. In both systems high combustion efficiency occurred when reaction of the gaseous fuel components was initiated in the extreme fore end of the mixing region between the fuel and the airstream. This is accomplished by reducing the primary exhaust velocity. It has been shown for the ducted rocket system that only when combustion of the gaseous fuel components occurred in the fore end of the mixing region, where near stoichiometric mixture ratios exist, the resulting gasphase combustion temperatures were high enough to heat the boron particles in the secondary chamber to a temperature necessary for rapid boron combustion. In tests, in particular at low secondary chamber pressure, reaction of the gaseous fuel components, however, did not occur in the beginning of the mixing region because of incomplete mixing of the reactants on the molecular scale. When gas-phase reaction was initiated further downstream, in regions with higher local air-to-fuel ratios, the local gas-phase combustion temperatures were far below the ignition temperature for boron particles. The highest possible local gas-phase combustion temperatures are also essential for the external burning ramjets. In these systems, without boron particles, highest gas-phase combustion temperatures from reaction in the extreme fore end of the mixing region are necessary to initiate carbon (soot) combustion and to achieve high reaction rates of the gaseous fuel components. It is now common practice to search for improvement of the combustion efficiency of external burning ramjets by increasing the penetration of the fuel into the airstream; the results of these preliminary tests suggest that high combustion efficiency can be achieved when reaction in the extreme fore end of the mixing region with the air can be initiated in a way that excessive mixing rates with the air, and therefore dilution of the combustion temperatures, is avoided.

The reduction of the primary motor exhaust to subsonic speed is a practical approach for improving combustion efficiency in external burning ramjets. This can be achieved by using two throats in the primary motor. The upstream throat controls the conditions for the solid propellant combustion; the larger downstream throat controls the pressure ratio (and, therefore, the exhaust velocity) at the fuel inlet into the airstream.

What is claimed is:

1. A projectile, comprising:

a body portion terminated in a bluff base and having an internal combustion chamber;

a solid propellant grain within said combustion chamber and configured to produce products of partial combustion;

a primary nozzle having a throat communicating with said combustion chamber, said throat being dimensioned to produce sonic flow of said products of partial combustion; and secondary nozzle means having at least one passage extending through said body portion and communicating with said primary nozzle throat for subsonically passing said products of partial combustion to the exterior of said body portion for further combustion of said products of partial combustion exterior to said body portion;

whereby said further combustion creates a pressure on said bluff base.

2. A projectile according to claim 1 in which said grain includes a particulate fuel additive.

3. A projectile according to claim 2 in which said particulate fuel additive includes boron.

4. A projectile according to claim 2 in which said particulate fuel additive includes magnesium-aluminum /alloy.

5. A projectile according to claim 1 in which said secondary nozzle means includes a plurality of injection ports.

6. A projectile according to claim 5 in which said injection ports extend through said body portion forward of said bluff base.

7. A projectile according to claim 1 in which said secondary nozzle means is constructed to reduce sonic flow from said primary nozzle to subsonic flow.

8. A projectile comprising:

a body portion terminated in a bluff base;

a combustion chamber within said body portion;

a grain of solid propellant within said combustion chamber;

a primary nozzle communicating with said combustion chamber and dimensioned to promote combustion of said grain;

secondary nozzle means extending through said body portion and communicating with said primary nozzle for passing the combustion products therethrough to the atmosphere, whereby further combustion exterior to said body portion provides a pressure increase on said bluff base.

* * * * *